US006233882B1

(12) United States Patent
Breaux

(10) Patent No.: US 6,233,882 B1
(45) Date of Patent: May 22, 2001

(54) BASEBOARD SAVER TOOL AND METHOD OF USE

(76) Inventor: Michael R. Breaux, 207 Gloria St., Apartment A, Thibodaux, LA (US) 70301

( * ) Notice: Subject to any disclaimer, the term of this patent is extended or adjusted under 35 U.S.C. 154(b) by 0 days.

(21) Appl. No.: 09/326,714

(22) Filed: Jun. 7, 1999

(51) Int. Cl.[7] ..... E04B 1/72

(52) U.S. Cl. ..... 52/98; 52/287.1; 33/405; 33/526; 118/504; 118/505

(58) Field of Search ..... 52/98, 207.1, 290; 33/405, 526; 118/504, 505

(56) References Cited

U.S. PATENT DOCUMENTS 5,450,698 * 9/1995 Hoopengardner ..... 52/287.1
5,584,149 12/1996 Wilson .
5,595,041 1/1997 Hoopengardner .
5,819,481 10/1998 Wilson .
5,897,816 * 4/1999 Johnson ..... 264/35
5,943,829 * 8/1999 Wilson ..... 52/98

FOREIGN PATENT DOCUMENTS 2198941 6/1988 (GB) .
2290993 1/1996 (GB) .

* cited by examiner

*Primary Examiner*—Carl D. Friedman
*Assistant Examiner*—Yvonne M. Horton
(74) *Attorney, Agent, or Firm*—Richard C. Litman

(57) ABSTRACT

A baseboard saver tool for preventing damage to a baseboard during installation of a carpeting tacking strip. The tool includes an upright rectangular board with a support arm attached thereto. The support arm is hinged and locked in the open position or folded for storage or portage. A cushion strip along the bottom rear edge of the board protects the baseboard from any abrasion by the tool and functions as a spacing aid element.

9 Claims, 4 Drawing Sheets

BASEBOARD SAVER TOOL AND METHOD OF USE

BACKGROUND OF THE INVENTION

1. Field of the Invention

The present invention relates generally to a baseboard protecting tool used during the installation of tacking strips for carpeting. More specifically, the tool is a rectangular upright board having a folding supporting arm or foot proximate one edge in front and a cushion strip at its bottom and rear surface.

2. Description of the Related Art

The related art of interest describes various protective devices to protect the floor baseboards or carpet during painting of the molding or the installation of carpeting, but none describes the innovative structure of the present invention. The problem with existing protecting devices is the residual portion left under the tacking strip or the adherence of the protector to the wall to risk removal of the existing paint. The related art will be described in the order of perceived relevance to the present invention.

U.S. Pat. No. 5,584,149 issued on Dec. 17, 1996, and U.S. Pat. No. 5,819,481 issued on Oct. 13, 1998, to Roger D. Wilson describe a wall and molding (baseboard) protector device during carpet installation. The device consists of a flexible upright rectangular board of fiberboard or cardboard 5–9 in. wide and 4 ft. long to match the length of a conventional tack strip. The flexible board can have a series of perforations for folding purposes parallel to one or both edges of a length and, alternatively multiple parallel perforations along one length. The flexible board is bent at a perforation to form a horizontal anchor portion which is placed below the tack strip. This device allows the carpet layer to stretch, trim and tuck the carpet along the baseboard or wall without damaging the finish. After installation of the carpet, the upright portion of the flexible board is separated from the anchor portion. When new tack strips are installed, the tack strips are nailed directly into the underlying anchor portion. When old tack strips are present, the strips are pried up and the anchor portion slipped under for retacking with only frictional engagement. An alternative embodiment utilizes two separate portions connected by an adhesive. Other embodiments include an integral plastic tack strip with an anchor portion or a plastic anchor portion wrapped around a plastic tack strip. The device is distinguishable for being limited to a flexible protective device which is used only once if singly perforated and repeatedly if multiple perforated with a portion left under the tack strip. Other embodiments teach away by utilizing integrated shield and tack strip devices made of plastic or fiberboard materials without mention of a separation of the upright portion from the tack strip with perforated material.

U.K. Patent Application No. 2,290,993 published on Jan. 17, 1996, Trevor Lawrence describes an adhesive bordered dust sheet for the purpose of protecting skirting boards and floor coverings when painting walls. The adhesive is protected initially by a removable backing, and provides a seal when applied to the skirting boards or carpet. The dust sheet is distinguishable for its limitation to covering materials for painting purposes.

U.K. Patent Application No. 2,198,941 published on Jun. 29, 1988, Martin F. Brown describes a carpet edge protector serving as a draught or draft excluder, a carpet protector during decoration, and a skirting protector during cleaning and dyeing of a carpet. A flexible plastic strip has a socket on its bottom edge to engage an end rib of the plastic edge protector formed of an upright portion and a horizontal portion hinged by a necked portion. A carpet grip (tacking strip with nails) is placed on the horizontal portion. The carpet edge is abutted against the upright portion over a felt base. The skirting protector is added over the carpet for painting the baseboard or placed against the baseboard for dyeing or cleaning of the carpet. The carpet edge protector is distinguishable for its permanent installation along the carpet's edge with the skirting protector attached for the above named purposes.

U.S. Pat. No. 5,595,041 issued on Jan. 21, 1997, to Merle R. Hoopengardner describes a carpet installation method using a flexible carpet base for wall-to-wall carpeting. The carpet base has flat planar portion for abutting the wall and an outwardly extending bead or flange positioned to engage the surface of the carpet and to cover its edge. The carpet base is distinguishable for its permanent installation for wall-to-wall carpeting.

None of the above inventions and patents, taken either singularly or in combination, is seen to describe the instant invention as claimed. Thus, a base board saver solving the aforementioned problems is desired.

SUMMARY OF THE INVENTION

The present invention is directed to a tool for preventing damage to a baseboard during installation of a carpeting tacking strip. The tool comprises an upright rectangular board with a folding support arm or foot on a side edge. A cushion strip along the bottom rear edge of the board protects the baseboard from any abrasion by the tool and functions as a spacing aid element.

Accordingly, it is a principal object of the invention to provide a baseboard protection device during the installation of tack strips for installation of carpeting.

It is another object of the invention to provide a baseboard protection device comprising an upright board with an inclined support arm which folds for storage.

It is a further object of the invention to provide a baseboard protection device including a cushion strip on the rear of the device to abut against the baseboard.

Still another object of the invention is to provide a baseboard protection device having a board and support arm made from materials selected from the group consisting of steel, plastic and aluminum.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
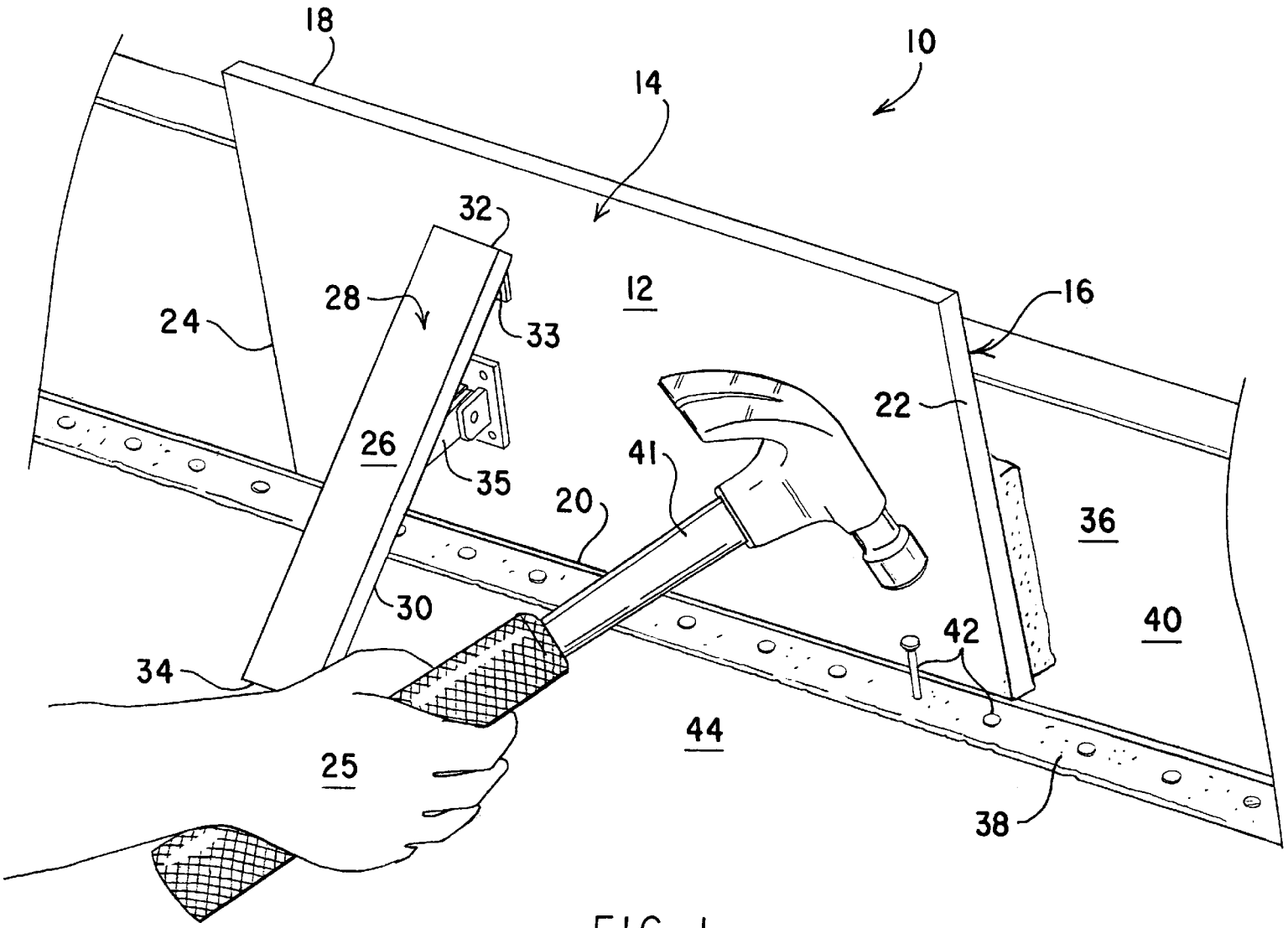
FIG. 1 is an environmental, perspective view of a baseboard saver according to the present invention.
Figure 2:
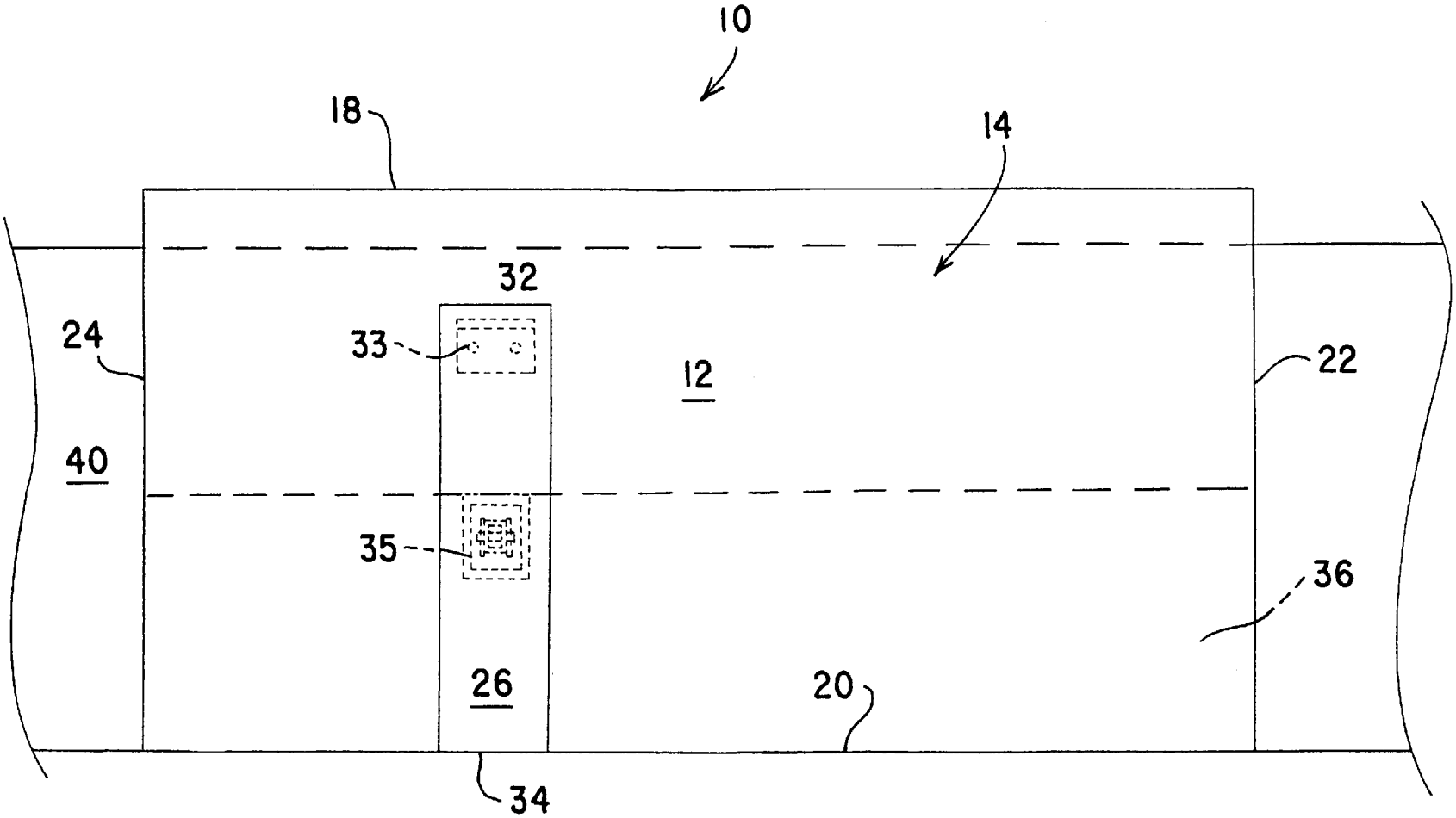
FIG. 2 is a front elevational view of the tool.
Figure 3:
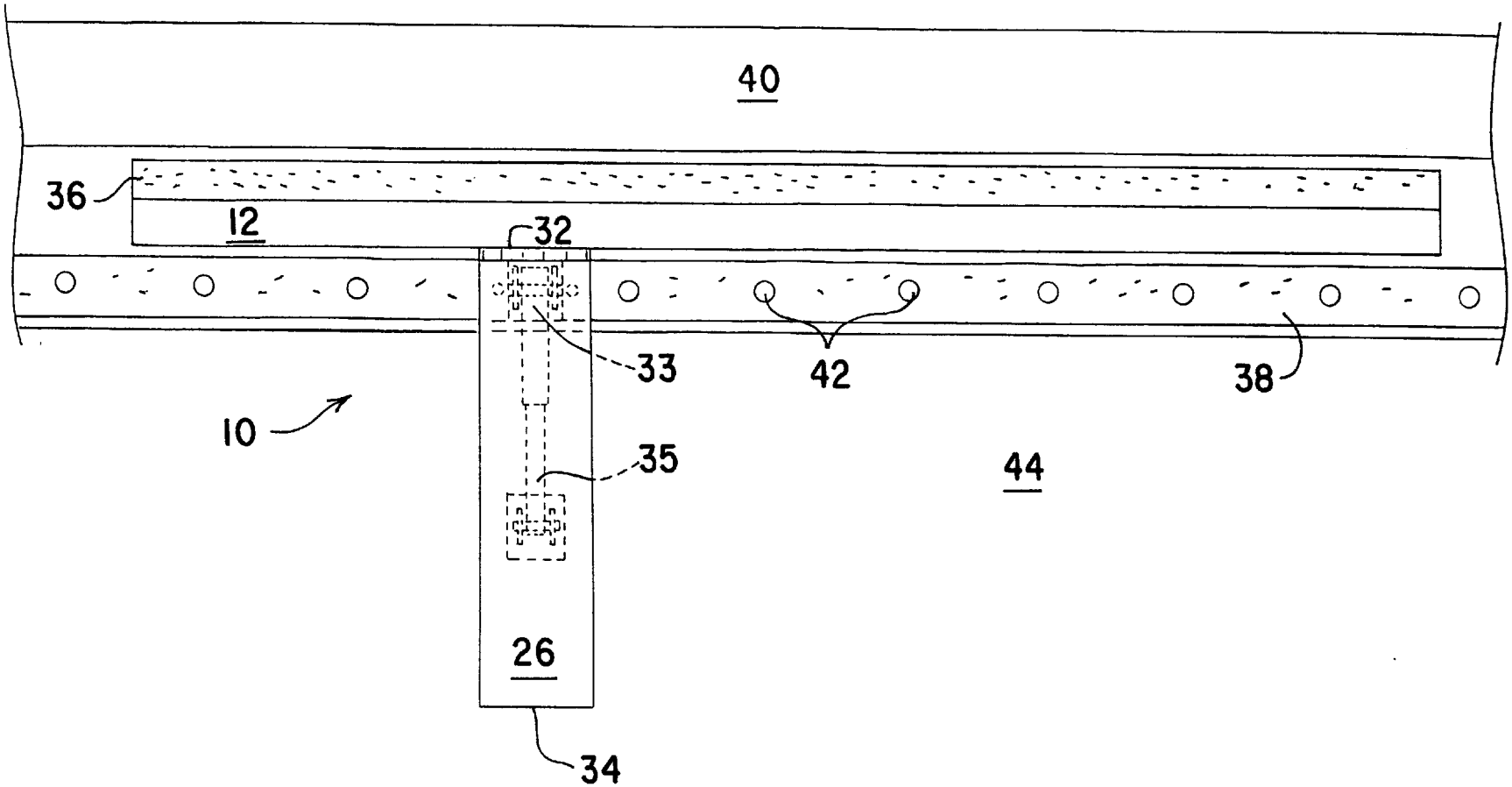
FIG. 3 is a top plan view of the tool.

In FIGS. 1–4, the present invention is directed to a baseboard saver tool 10 comprising a rectangular board 12 having a front surface 14, a rear surface 16, an elongated top edge 18, an elongated bottom edge 20, a right side edge 22 and a left side edge 24.

Figure 4:
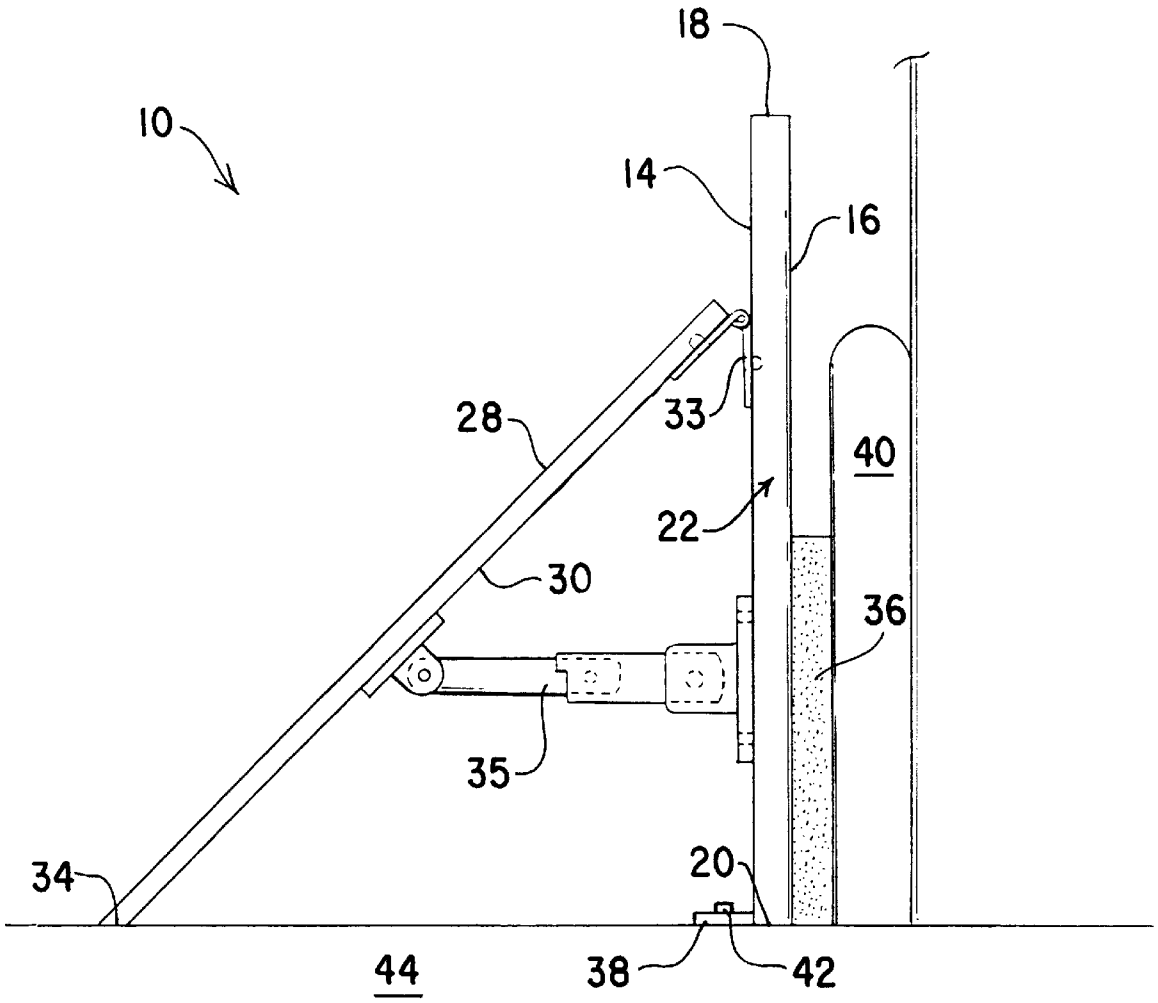
FIG. 4 is side view of the tool.

A folding support arm 26 is attached to the board, an elongated top side 28, an elongated shorter bottom side 30, (as best shown in FIG. 4) a board contacting edge 32, and a floor contacting end 34. The top side 28 forms approximately a 45° angle with the board contacting side 32 and the floor contacting end 34. A hinge 33 is attached at the board contacting end 34 of the arm 26 to permit the folding of the arm for storage or portage. Also, a lockable and folding lock arm 35 is attached between the front surface 14 of the board 12 and a midpoint of the support arm 26. Alternatively, the arm 26, can be connected permanently to the board 12 by mortising or the like (not shown). It should be noted that the support arm 26 is depicted as being proximate the left side edge 24 of the board 12 for a right-handed worker 25, but the support arm 26 can be located proximate the right side edge 22 for a left-handed worker.

A rectangular cushion strip 36, preferably made of a firm felt or the like, commensurate in length with the elongated bottom surface 20 of the board 12 is positioned on the rear surface 16 and the elongated bottom surface 20 of the board. A carpet tacking wood strip 38 can then be positioned proximate a baseboard 40 without damaging the baseboard with a hammer 41 during the installation of the carpet tacking wood strip 38 with nails 42 on a floor 44.

The baseboard saver tool 10 can be made of steel, aluminum or plastic material. An exemplary board 12 can be 10 in. high, 20 in. long and 0.25 in. thick. The board 12 can be made thinner for baseboards 40 that are flush with the slab or floor.

The baseboard saver tool 10 serves another important function of uniformly spacing the tack strips 38 at least 0.375 in. from the baseboard 40. The use of the tool 10 enables even inexperienced people like floor installers, their helpers and homeowners to efficiently install the tack strips 38 and carpeting without damaging the baseboards 40. In the event that a concrete floor is involved, installation of a tack strip 38 is made more efficient by the tool 10, because pebbles in the concrete slab might cause the tack strip to slide toward the existing baseboard 40. The cushion strip 36 prevents scratching of the baseboard 40 by the tool 10 during the installation of the tack strips 38.

It is to be understood that the present invention is not limited to the embodiment described above, but encompasses any and all embodiments within the scope of the following claims.

I claim:

1. A baseboard saver tool for protection of a baseboard during an installation of carpeting tack strips on a floor comprising:

a rectangular board having a front surface, a rear surface, an elongated top edge, an elongated bottom edge, a right side edge and a left side edge;

a support arm having a board contacting end hingedly attached to the front surface of said board and a floor contacting end;

a folding lock arm disposed between the support arm and the board for locking the support arm during use of the tool and for folding the support arm during storage and portage of the tool; and a rectangular cushion strip commensurate in length with the elongated bottom edge and positioned on the rear surface and proximate the elongated bottom edge;

whereby a carpet tacking wood strip is positioned proximate a baseboard without damaging the baseboard or preventing its entry under a baseboard during the installation of the carpet tacking wood strip on a floor.

2. The baseboard saver tool according to claim 1, wherein the support arm is positioned proximate to a left side edge of the board for a right-handed worker.

3. The baseboard saver tool according to claim 1, wherein the support arm is positioned proximate to a right side edge of the board for a left-handed worker.

4. The baseboard saver tool according to claim 1, wherein the board is made of a material selected from the group consisting of steel, aluminum and plastic.

5. The baseboard saver tool according to claim 1, wherein the board is approximately 10 inches high, 20 inches long and 0.375 inch in thickness.

6. The baseboard saver tool according to claim 1, wherein the cushion strip is made of a firm felt material.

7. A method of installing carpeting tack strips on a floor proximate a baseboard without damaging the baseboard comprising:

providing a baseboard saver tool comprising:

a rectangular board having a front surface, a rear surface, an elongated top edge, an elongated bottom edge, a right side edge and a left side edge;

a support arm having a board contacting end hingedly attached to the front surface of said board, and a floor contacting end;

a lock arm disposed between the support arm and the board for locking the support arm during use of the tool and for folding the support arm during storage and portage of the tool; and a rectangular cushion strip commensurate in length with the elongated bottom edge and positioned on the rear surface and proximate the elongated bottom edge;

placing the tool against the baseboard;

placing a tack strip against the tool and on the floor; and installing the tack strip by nailing the tack strip to the floor; whereby a carpet is installed without damaging the baseboard.

8. The method according to claim 7, wherein the support arm is positioned proximate to a left side edge of the board for a right-handed worker.

9. The method according to claim 7, wherein the support arm is positioned proximate to a right side edge of the board for a left-handed worker.

* * * * *